US007029568B2

(12) United States Patent
Matsuo et al.

(10) Patent No.: US 7,029,568 B2
(45) Date of Patent: Apr. 18, 2006

(54) NEGATIVE ION GENERATING MEDIUM AND ITS MANUFACTURING METHOD

(75) Inventors: Yuichiro Matsuo, Shiga-ken (JP); Takayasu Ikeda, Otsu (JP)

(73) Assignee: GHA Corporation, Shiga (JP)

( * ) Notice: Subject to any disclaimer, the term of this patent is extended or adjusted under 35 U.S.C. 154(b) by 39 days.

(21) Appl. No.: 10/715,403

(22) Filed: Nov. 19, 2003

(65) Prior Publication Data

US 2004/0224178 A1 Nov. 11, 2004

(51) Int. Cl.

| | |
|---|---|
| ***C25D 11/18*** | (2006.01) |
| ***C25D 11/20*** | (2006.01) |
| ***C25D 5/44*** | (2006.01) |
| ***C25D 11/04*** | (2006.01) |
| ***C25C 1/22*** | (2006.01) |

(52) U.S. Cl. ..... 205/229; 205/43; 205/45; 205/46; 205/173; 205/174; 205/213; 205/324

(58) Field of Classification Search ..... 205/43, 205/45, 46, 173, 174, 229, 324, 213
See application file for complete search history.

(56) References Cited

U.S. PATENT DOCUMENTS 4,310,586 A * 1/1982 Sheasby et al. ..... 428/220
6,540,901 B1 * 4/2003 Mayers et al. ..... 205/214

FOREIGN PATENT DOCUMENTS

| | | |
|---|---|---|
| EP | 1207220 A1 | 5/2002 |
| EP | 1207220 A1 * | 5/2002 |
| JP | 2001-161414 | 6/2001 |
| JP | 2001-288679 | 10/2001 |
| JP | 2001-295105 | 10/2001 |

* cited by examiner

*Primary Examiner*—Edna Wong
(74) *Attorney, Agent, or Firm*—Westerman, Hattori, Daniels & Adrian, LLP

(57) ABSTRACT

A negative ion generating medium for generating negative ions from the surface of a mother material made of aluminum or aluminum alloy. The negative ion generating medium has the mother material of aluminum or aluminum alloy covered at the surface with an anodized layer on which a rare metal separated from a rare metal solution such as zirconium salt is deposited. As the rare metal is deposited in the pores provided in the anodized layer, its negative ion generating area can be increased thus releasing a large number of negative ions. The negative ion generating medium is manufactured by electrolytically processing the mother material in an electrolyte solution of sulfuric acid doped with a rare metal salt such as lithium salt to develop the anodized layer on the surface of the mother material and deposit the rare metal on the anodized layer.

8 Claims, 4 Drawing Sheets

NEGATIVE ION GENERATING MEDIUM AND ITS MANUFACTURING METHOD

FIELD OF THE INVENTION

The present invention relates to a negative ion generating medium for generating (emitting) negative ions from the surface of a mother material made of aluminum or aluminum alloy and a method of manufacturing the negative ion generating medium.

BACKGROUND OF THE INVENTION

It has been reported that as positive ions in the air are increased by the effect of acid rain and exhaust gas resulting from the daily activities in cities, negative ions decrease and the environment and the living of human beings, animals, and plants may thus be deteriorated. It is also known that the increase of positive ions greater than negative ions may accelerate oxidizing corrosion, vital fault, and aging. In addition, the living creatures and water may slowly be acidified. As negative ions are generated for compensating the shortage, their abundance can reduce the weak acids to neutrals. Negative ions are commonly generated in the woods, the falls, and the seasides and their advantage is used for sedation and refreshment.

There are minerals including tourmaline, and Bakuhan stone, mottled stone for generating negative ions in the natural world. Such a mineral is milled to a powder form which is then solidified with a resin material to have a negative ion generating medium (for example, as denoted in Japanese Patent Laid-open Publication 2001-161414 or 2001-295105). Also, a fabric for generating negative ions is disclosed (for example, as denoted in Japanese Patent Laid-open Publication 2001-2888679). Moreover, proposed are air conditioners and air cleaners which can generate negative ions through electrical discharging.

However, the conventional negative ion generating mediums disclosed in the publications 2001-161414 and 2001-295105 employ simply a powder form of minerals which can generate a small but not large number of negative ions. Also, the other prior arts for generating negative ions through the electrical discharging action are bulky in the size and not simple in the construction, hence increasing the overall cost of production.

It is thus an object of the present invention to provide a negative ion generating medium which is manufactured from a mother material made of aluminum or its alloy thus decreasing the cost while generating a large number of negative ions.

It is another object of the present invention to provide a method of manufacturing a negative ion generating medium from a mother material of aluminum or its alloy for generating negative ions.

It is a further object of the present invention to provide a method of manufacturing a negative ion generating medium from a mother material surface finished by a simple manner for providing an anti-bacterial property and a deodorant property.

SUMMARY OF THE INVENTION

A negative ion generating medium according to the present invention is provided comprising an anodized layer provided on the surface of a mother material made of aluminum or aluminum alloy and a negative ion generating metal separated from a solution doped with a negative ion generating metal salt and deposited on the anodized layer.

The negative ion generating medium of the present invention allows the negative ion generating metal to be separated from the solution of the negative ion generating metal salt and deposited on the anodized layer thus to release (emit) a number of negative ions. The anodized layer has a porous structure where multiplicities of tiny pores are provided. As the negative ion generating metal is deposited in the porous structure, its negative ion generating area can be increased. Therefore, a large number of negative ions can be released.

The negative ion generating medium may be modified in which the negative ion generating metal is composed of one or more metals selected from zirconium, vanadium, lithium, yttrium, thorium, uranium, radium, and radon.

The modified negative ion generation medium of the present invention allows the negative ion generating metal composed of one or more metals selected from zirconium, vanadium, lithium, yttrium, thorium, uranium, radium, and radon to be separated and deposited on the anodized layer thus releasing (emitting) a number of negative ions.

A method of manufacturing a negative ion generating medium according to the present invention is characterized by electrolytically processing a mother material made of aluminum or aluminum alloy in an electrolyte liquid of sulfuric acid, oxalic acid, phosphoric acid, or their two or three combination doped with a negative ion generating metal salt to develop an anodized layer on the surface of the mother material and to deposit a negative ion generating metal from the negative ion generating metal salt on the anodized layer.

The method of the present invention allows the anodized layer to be developed and the negative ion generation metal to be deposited on the mother material of aluminum or aluminum alloy by a single action of the electrolytic process in the bath of sulfuric acid, oxalic acid, phosphoric acid, or their two or more combination. Accordingly, as the electrolytic process for depositing the negative ion generating metal is simplified and minimized in the operating duration, it can contribute to the reduction of the overall cost.

Another method of manufacturing a negative ion generating medium according to the present invention is characterized by electrolytically processing a mother material made of aluminum or aluminum alloy and covered at the surface with an anodized layer in an electrolyte liquid of sulfuric acid, oxalic acid, phosphoric acid, or their two or three combination doped with a negative ion generating metal salt and with either a metal nitrate such as silver nitrate, copper nitrate, or their combination or a metal sulfate such as silver sulfate, copper sulfate, or their combination to deposit a negative ion generating metal from the negative ion generating metal salt and a specific metal from the metal nitrate or metal sulfate on the anodized layer.

The another method of the present invention allows the specific metal (silver and/or copper) and the negative ion generating metal to be deposited on the anodized layer on the mother material by a single action of the electrolytic process in the electrolyte liquid of sulfuric acid, oxalic acid, phosphoric acid, or their two or three combination doped with a negative ion generating metal salt and with either a metal nitrate such as silver nitrate, copper nitrate, or their combination or a metal sulfate such as silver sulfate, copper sulfate, or their combination. While the negative ion generating metal deposited on the anodized layer releases a number of negative ions giving the negative ion effect, the specific metal (silver and/or copper) deposited simultaneously on the anodized layer can provide an anti-bacterial property. Meanwhile, the development of the anodized layer on the mother material can be carried out by any known manner.

A further method of manufacturing a negative ion generating medium according to the present invention is characterized by subjecting a mother material made of aluminum or aluminum alloy and covered at the surface with an anodized layer to the electrolytic process in a phosphoric acid bath to modify the shape of the anodized layer and electrically processing the mother material in an electrolyte liquid of sulfuric acid, oxalic acid, or their combination doped with a negative ion generating metal salt to deposit a negative ion generating metal from the negative ion generating metal salt on the anodized layer which has been modified in the shape.

The further method of the present invention allows the anodized layer developed on the mother material to be electrolytically processed in the phosphoric acid bath thus having the anodized layer of a porous structure increased in the size at the bottom of pores. After the electrolytic process with the phosphoric acid bath, the mother material is electrolytically processed in the electrolyte liquid of sulfuric acid, oxalic acid, or their combination doped with a negative ion generating metal salt. As the negative ion generating metal is deposited in the bottom of the pores at the porous structure of the anodized layer, its amount can be increased. Accordingly, the negative ion generating metal can release a more number of negative ions.

A still further method of manufacturing a negative ion generating medium according to the present invention is characterized by electrolytically processing a mother material made of aluminum or aluminum alloy and covered at least partially at the surface with a granular resin coating in an electrolyte liquid of sulfuric acid, oxalic acid, phosphoric acid, or their two or three combination doped with a negative ion generating metal salt to develop an anodized layer on the surface of the mother material and to deposit a negative ion generating metal from the negative ion generating metal salt on both the anodized layer and the granular resin coating.

The still further method of the present invention allows the mother material covered at least partially at the surface with the granular resin coating to be electrolytically processed in the electrolyte liquid of sulfuric acid, oxalic acid, phosphoric acid, or their two or three combination doped with a negative ion generating metal salt. Accordingly, both the development of the anodized layer on the surface of the mother material and the deposition of the negative ion generating metal on the anodized layer and the granular resin coating can be conducted by a single action of the electrolytic process.

The still further method of manufacturing a negative ion generating medium may be modified in which the granular resin coating is made of fluorine resin, phenol resin, or acrylic resin.

The modified still further method of the present invention has the granular resin coating made of fluorine resin, phenol resin, or acrylic resin hence allowing the anodized layer to be developed on the surface of the mother material across the granular resin coating of a porous structure and the negative ion generating metal to be deposited on both the anodized layer and the granular resin coating.

A still further method of manufacturing a negative ion generating medium is characterized by electrolytically processing a mother material made of aluminum or aluminum alloy and covered at least partially at the surface with a granular resin coating and then with an anodized layer in an electrolyte liquid of sulfuric acid, oxalic acid, phosphoric acid, or their two or three combination doped with a negative ion generating metal salt to deposit a negative ion generating metal from the negative ion generating metal salt on both the anodized layer and the granular resin coating.

The still further method of the present invention allows the mother material covered with the granular resin coating to be developed with the anodized layer and electrolytically processed in the electrolyte liquid of sulfuric acid, oxalic acid, phosphoric acid, or their two or three combination doped with a negative ion generating metal salt. Accordingly, the negative ion generating metal can be deposited on both the granular resin coating and the anodized layer by two steps of the action.

Each of the methods of manufacturing a negative ion generating medium can be modified in which the negative ion generating metal is composed of one or more metals selected from zirconium, vanadium, lithium, yttrium, thorium, uranium, radium, and radon.

The modified method of the present invention allows the negative ion generating metal composed of one or more metals selected from zirconium, vanadium, lithium, yttrium, thorium, uranium, radium, and radon to be deposited on the anodized layer.

The still further method of manufacturing a negative ion generating medium may be modified in which the electrolytic process is carried out using a commercial alternating current, an AC/DC combined current, a PR current at the negative mode, a pulse wave form current at the negative mode, or their combination.

The modified method of the present invention allows the electrolytic process to be carried out using a commercial alternating current, an AC/DC combined current, a PR current at the negative mode, a pulse wave form current at the negative mode, or their combination, whereby the negative ion generating metal can favorably be deposited.

DETAILED DESCRIPTION OF THE PREFERRED EMBODIMENTS

A negative ion generating medium according to an embodiment of the present invention will be described referring to FIGS. 1 and 2.

Figure 1:
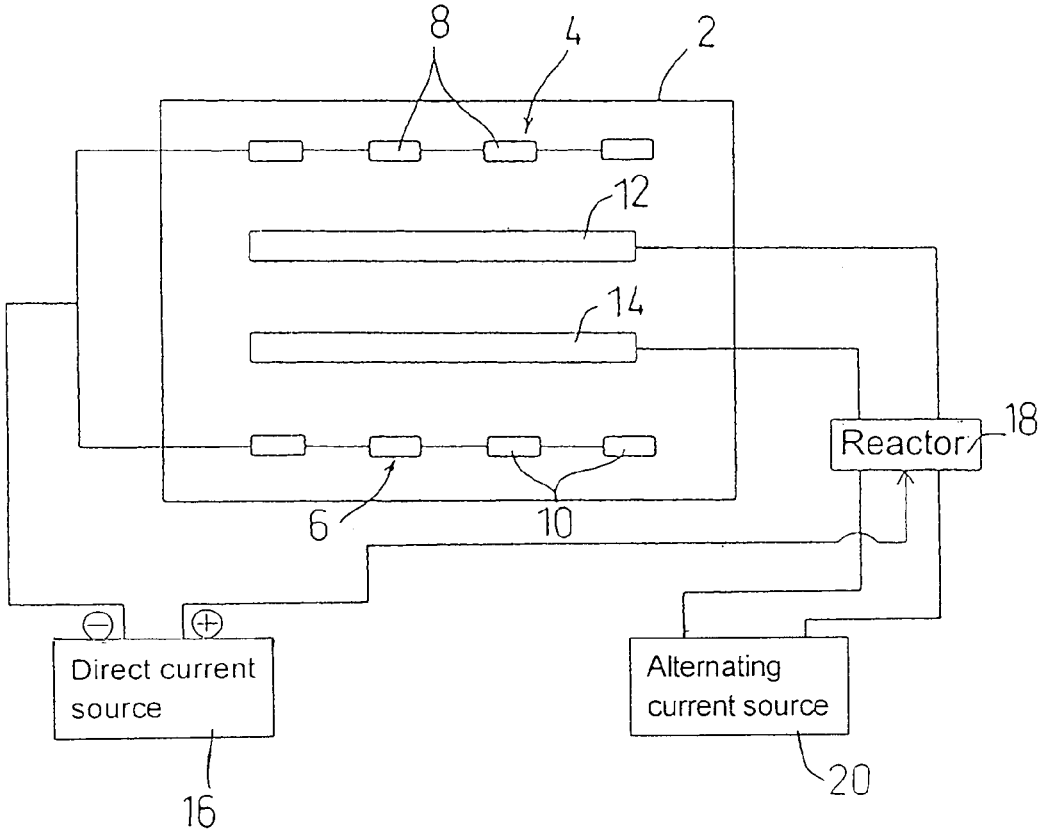
FIG. 1 is a schematic view showing schematically an exemplary treatment system for embodying a method of generating negative ions to manufacture a negative ion generating medium according to the present invention.

As shown in FIG. 1, the system includes an electrolyte vessel 2 of a cubic shape and a pair of electrodes 4 and 6 mounted on both sides of the electrolyte vessel 2. Each of the electrodes 4 and 6 incorporates four electrode plates 8 or 10 made of carbon and arranged in the lengthwise direction (from left to right in FIG. 1). The two electrodes 4 and 6 are electrically connected in parallel to each other. The four electrode plates 8 of the electrode 4 are electrically connected in series while the four electrode plates 10 of the electrode 6 are electrically connected in series.

A couple of mother materials 12 and 14 to be subjected to surface treatment for generation of negative ions (referred to as surface treatment hereinafter) are provided between the paired electrodes 4 and 6. More specifically, one 12 of the materials is located at the inner side of the electrode 4 while the other material 14 is located at the inner side of the electrode 6. The two mother materials 12 and 14 may be arranged of a plate shape made of aluminum or aluminum alloy. The system is designed for surface treatment of the aluminum or aluminum alloy materials 12 and 14, which will be explained later in more detail.

The electrolyte vessel 2 is filled with an electrolyte liquid for the surface treatment in which the mother materials 12 and 14 are immersed. The electrolyte liquid maybe a sulfuric acid bath, anoxalic acid bath, a phosphoric acid bath, or their two or three combination. The bath is also added with a negative ion generating metal salt. The negative ion generating metal salt contains a specific metal for simply triggering the generation of negative ions and a radioactive metal for exhibiting radioactive properties and generating negative ions. The specific metal for triggering the generation of negative ions may be selected from zirconium, vanadium, lithium, and yttrium. The radioactive metal may be selected from thorium, uranium, radium, and radon. The electrolyte liquid is added with one or more of the negative ion generating metal salts which may preferably be 2 to 10 g/l. If the negative ion generating metal salt is smaller than 2 g/l, the deposition of the negative ion generating metal will be declined during the surface treatment. When the negative ion generating metal salt is greater than 10 g/l, it may cause a resultant anodized layer developed by the surface treatment to have faults such as pits (due to porous corrosion).

For the surface treatment, the mother materials 12 and 14 are loaded with an AC/DC combined waveform current which is a mixture of an alternating current and a direct current at a positive mode and subjected to the electrolytic action. In this embodiment, the positive port of a direct current source 16 is electrically connected to a reactor 18 while the negative port is electrically connected to the paired electrodes 4 and 6 (at the electrode plates 8 and 10). Also, an alternating current source 20 is electrically connected to the reactor 18. The reactor 18 superimposes the positive current from the direct current source 16 on the alternating current from the alternating current source 20 and feeds the mother materials 12 and 14 with the resultant AC/DC combined current.

For the surface treatment, the current is controlled to stay within a range of, for example, 1 to 10 A/dm$^2$ in the density. The current is supplied continuously at the density range for a predetermined length of time. When the current density exceeds 10 A/dm$^2$, the anodized layer developed by the surface treatment will be burnt or browned. Also, the interface between the mother materials 12 and 14 and their holding jigs may be injured by the electric discharge. When its density is lower than 1 A/dm$^2$, the current will run through the electrolyte liquid with much difficulty thus declining the efficiency of the surface treatment.

For the surface treatment, the electrolyte liquid is controlled to stay at a temperature of, for example, −10 to 25° C. When the electrolyte liquid exceeds 25° C., the anodized layer developed on the mother materials 12 and 14 will be softened and if worse, hardly leveled at the surface. When the electrolyte liquid is lower than −10° C., the surface treatment will be declined in the efficiency and increased in the cost.

Figure 2:
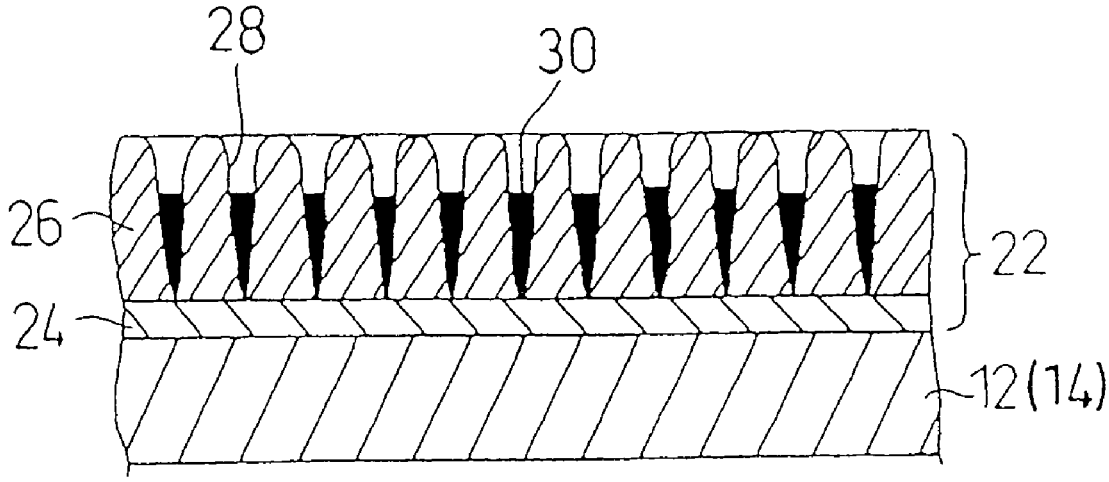
FIG. 2 is a partially enlarged cross sectional view of a mother material processed with the treatment system shown in FIG. 1.

As the mother materials 12 and 14 have been subjected to the surface treatment with the foregoing system, their surface is finished as shown in FIG. 2. The mother material 12 (14) made of aluminum or aluminum alloy is covered at the surface with an anodized layer 22 (of so called alumite). The anodized layer 22 consists of a barrier layer 24 on the surface of the material 12 and a porous layer 26 on the barrier layer 24. The barrier layer 24 has a thickness of about 0.01 to 0.1 μm. The porous layer 26 has a thickness of about 10 to 200 μm.

The surface treatment allows a negative ion generating metal to be separated from the negative ion generating metal salt and deposited in the pores 28 in the porous layer 26; more particularly, zirconium when the dopant is zirconium salt, vanadium when it is vanadium salt, lithium when it is lithium salt, yttrium when it is yttrium salt, and thorium when it is thorium salt. The negative ion generating metal 30 is deposited at the bottom of the pores 28. The negative ion generating metal may be selected from zirconium, vanadium, lithium, yttrium, thorium, uranium, radium, and radon. When one or more negative ion generating metal salts are used as the dopant, their metals are deposited in the pores 28 of the porous layer 26 by the surface treatment. The deposition of the negative ion generating metals hence provides the mother material 12 (14) with a negative ion generating function for releasing negative ions. Also, the mother material 12 (14) is covered at the surface with the anodized layer 22, it will increase its hardness at the surface and improve its resistance to wear. Particularly, the harder the anodized layer 22 , the higher the resistance to wear of the mother material 12 (14) can be obtained.

Although the AC/DC combined waveform current is employed for the surface treatment in the embodiment, it may be replaced by a PR waveform current at the negative mode or a pulse waveform current at the negative mode. In any case, the procedure can be executed by a single action of the electrolytic process for developing the anodized layer 22 on the mother materials 12 and 14 and separating the negative ion generation metal from the anodized layer 22.

The development of the anodized layer 22 on the mother materials 12 and 14 made of aluminum or aluminum alloy is not limited to that of the embodiment but may be modified by a granular resin coating, such as a fluorine resin coating, provided on the mother material of aluminum or aluminum alloy and then covered at the surface with the anodized layer from which a negative ion generating metal is separated for releasing negative ions.

Figure 3:
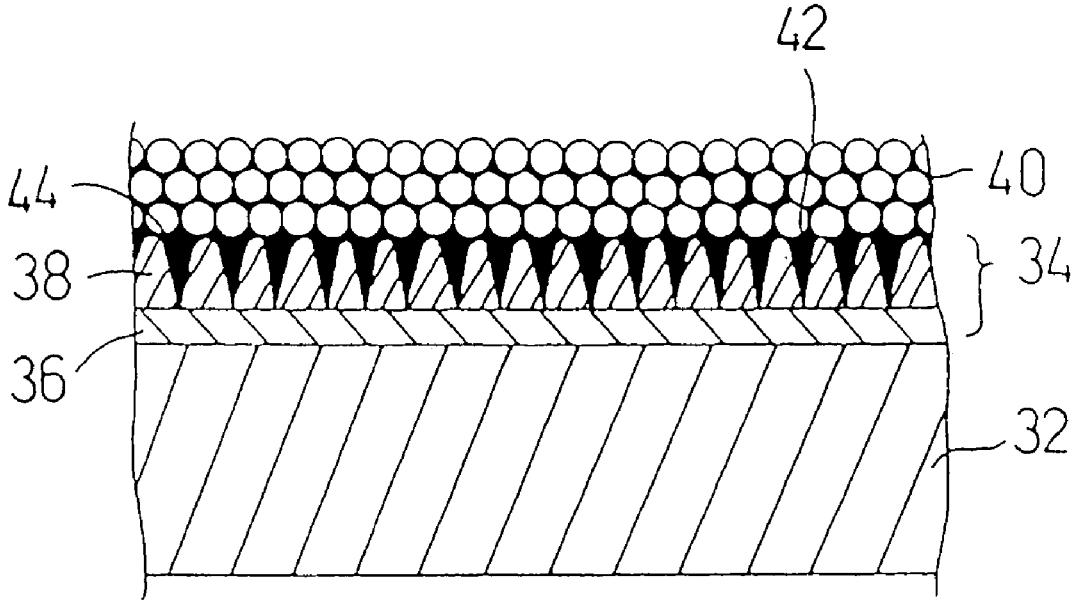
FIG. 3 is a partially enlarged cross sectional view of another mother material processed by the treatment system shown in FIG. 1.

For the surface treatment with the foregoing system, the granular resin or fluorine resin coated mother material is immersed into the electrolyte liquid and supplied with the described current. The result of the fluorine resin coated mother material is illustrated in FIG. 3. An anodized layer 34 is developed on the material 32 covered with the granular resin coating 40. The anodized layer 34 consists of a barrier layer 36 directly on the material 32 and a porous layer 38 on the barrier layer 36. With the fluorine resin coating 40 provided on the material 32, the material 32 remains less susceptive to the electrolyte liquid and the anodized layer 34 developed on its surface has as a small thickness as 2 to 4 μm. The thickness of 2 to 4 μm contains the barrier layer 36 and the porous layer 38.

Similarly in the surface treatment, the negative ion generating metal (selected from zirconium, vanadium, lithium, yttrium, thorium, uranium, radium, radon, and their two or more combination) can be separated from the negative ion generating metal salt and deposited in the pores 42 of the porous layer 38 at the upper side of the anodized layer 34.

In addition, the negative ion generating metal is deposited in the fluorine resin coating 40. More specifically, the deposition of the negative ion generating metal is proceeded from the anodized layer 34 towards the upper surface of the fluorine resin coating 40. Since the fluorine resin coating 40 is an assembly of tiny round granules as shown in FIG. 3, it has a multiplicity of mutually communicated voids provided therein. The voids allows the electrolyte liquid to pass through and act on the surface of the mother material 12. Accordingly, while the anodized layer 34 on the material 32 is developed to a small thickness, the negative ion generating metal in the electrolyte liquid can be deposited in the voids of the fluorine resin coating 40 as well as in the pores 42 of the porous layer 38 of the anodized layer 34 across the fluorine resin coating 40.

As the mother material 32 having the fluorine resin coating 40 provided thereon is covered at the surface with the anodized layer 34, it can be increased in the hardness and thus the resistance to wear. Also, the negative ion generating metal 44 is deposited on the fluorine resin layer 40 as well as the anodized layer 34 and allows the mother material 32 to have the negative ion generating effect for releasing negative ions.

The granular resin coating on the mother material 32 is not limited to the fluorine resin coating 40 of the embodiment but may be implemented by a phenol resin coating or an acrylic resin coating (having continuous voids provided therein). In any case, the mother material covered with the granular resin coating is subjected to the electrolytic process for developing an anodized layer on the surface thereof, thus allowing negative ion generating metal(s) to be deposited on both the anodized layer and the granular resin coating.

While both the development of the anodized layer on the material covered with the granular resin coating and the deposition of negative ion generation metal on the anodized layer are carried out by a single action of the electrolytic process, they may be executed in two separate steps. The latter case may comprise a step of immersing the material covered with the granular resin coating into a sulfuric acid bath, an oxalic acid bath, a phosphoric acid bath, or their two or three combination for the anodization and another step of electrolytic processing with the electrolyte liquid doped with a negative ion generating metal salt (for example, zirconium salt, vanadium salt, lithium salt, yttrium salt, or thorium salt). This can also permit the development of the anodized layer and the deposition of negative ion generating metal on the anodized layer. The electrolytic process can be carried out using a variety of currents including a commercial alternating current, an AC/DC combined current, a PR waveform current at the negative mode, and a pulse waveform current at the negative mode.

The procedure may be implemented by developing the anodized layer on the surface of the mother material made of aluminum or aluminum alloy with the use of a known manner and carrying out an electrolytic process with the electrolyte liquid doped with a proper negative ion generating metal salt to separate a negative ion generating metal.

Figure 4:
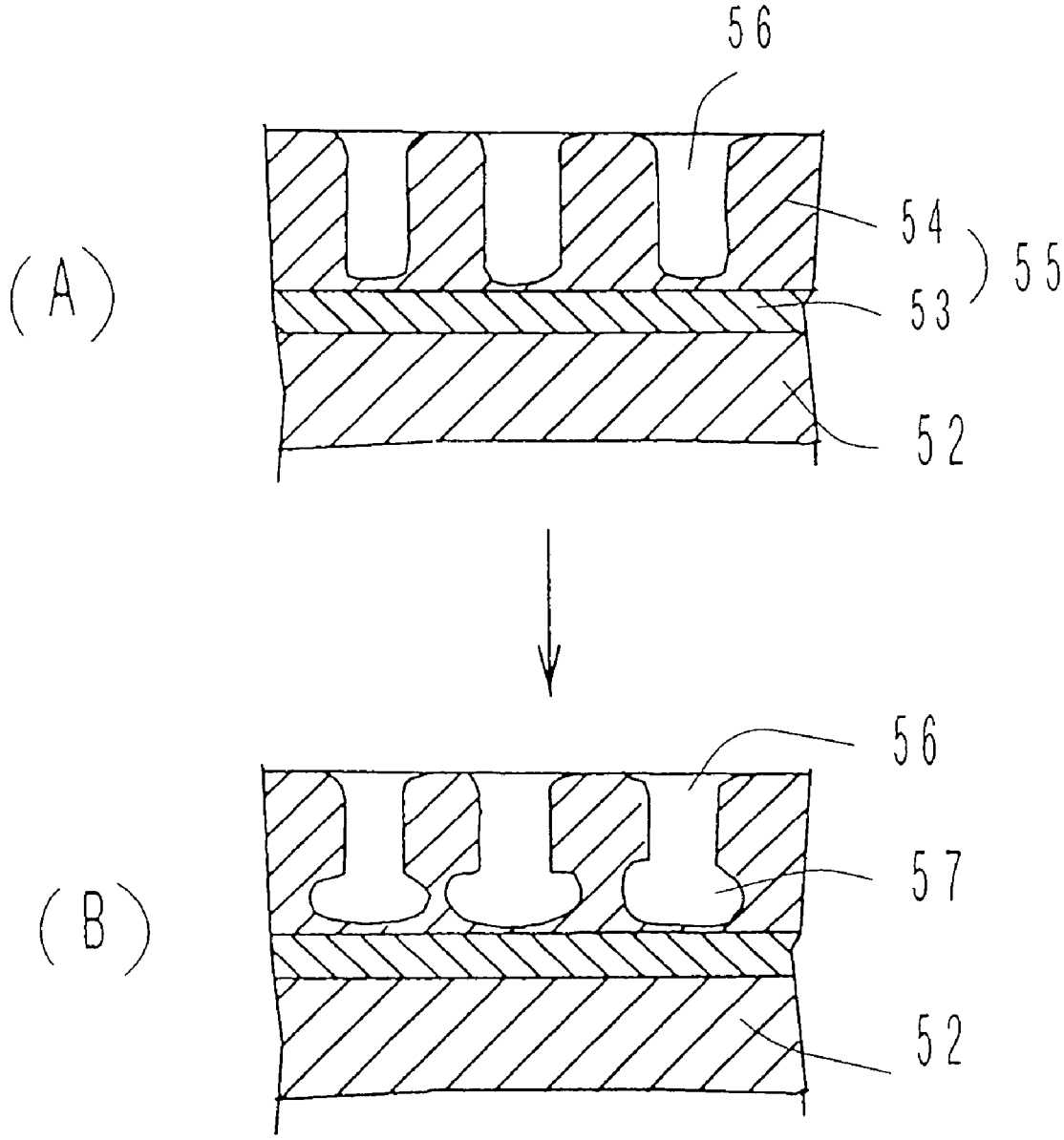
FIGS. 4*a* and 4*b* are partially enlarged cross sectional views of the mother material before and after the electrolytic process in a phosphoric acid bath.

Also, the procedure may be implemented by developing the anodized layer on an aluminum or aluminum alloy material, carrying out an electrolytic process with the use of a phosphoric acid bath, and depositing a negative ion generating metal. As shown in FIG. 4A, the anodized layer denoted by 55 developed on the material 52 made of aluminum or aluminum alloy is a combination of a barrier layer 53 and a porous layer 54 having a thickness of about 20 μm. It is assumed that the material 52 covered with the anodized layer 55 is then subjected to the electrolytic process using an electrolyte liquid which contains 50 g/l of phosphoric acid. Consequently, the porous layer 54 of the anodized layer 55 has voids 56 provided with wide regions 57 widened at the bottom as shown in FIG. 4B. After the electrolytic process with the phosphoric acid bath, the negative ion generating metal (zirconium, vanadium, lithium, yttrium, thorium, uranium, radium, radon, or their two or more combination) is deposited in the wide regions 57 of each void 56 of the porous layer 54. As the result, the deposited metal is increased in the amount and its releasing of negative ions can be increased. It is assumed that the material 52 covered with the anodized layer 55 is then subjected to the electrolytic process using an electrolyte liquid which contains 50 g/l of phosphoric acid. Consequently, the porous layer 56 of the anodized layer 55 has voids 56 provided with wide regions 57 widened at the bottom as shown in FIG. 4B. After the electrolytic process with the phosphoric acid bath, the negative ion generating metal (zirconium, vanadium, lithium, yttrium, thorium, uranium, radium, radon, or their two or more combination) is deposited in the wide regions 57 of each void 56 of the porous layer 54. As the result, the deposited metal is increased in the amount and its releasing of negative ions can be increased.

Although the negative ion generating metal is deposited on the anodized layer (with the granular resin coating added) developed on the surface of the mother material according to the embodiment, silver and/or copper may be deposited in addition to the negative ion generating metal for providing an anti-bacterial property. In the latter case, the mother material is covered with the anodized layer and immersed into a sulfuric acid bath, an oxalic acid bath, a phosphoric acid bath, or their two or three combination which is added with a nitrate namely silver nitrate and/or copper nitrate and also with a negative ion generating metal salt (zirconium salt, vanadium salt, lithium salt, yttrium salt, or their two or more combination) for the electrolytic process. As the result of the electrolytic process, the negative ion generating metal (zirconium, vanadium, lithium, yttrium, thorium, uranium, radium, radon, and their two or more combination) is separated from the added negative ion generating metal salt and deposited on the anodized layer. The metal (silver and/or copper) is separated from the added nitrate and deposited on the anodized layer. The nitrate may be replaced by a sulfate namely silver sulfate and/or copper sulfate. This can also allow silver and/or copper to be deposited for providing an anti-bacterial property.

The solution of a negative ion generating metal salt, such as zirconium salt, vanadium salt, or yttrium salt, may be prepared by dissolving 20 g of zircon, yttrialite, xenotime, or columbite (in granule or powder form) into 100 ml of a strong acid such as sulfuric acid.

EXAMPLES AND COMPARISONS

Example 1

Example 1 of the electrolytic process was carried out with the treatment system shown in FIG. 1 using as the electrolyte liquid 250 g/l of sulfuric acid doped with 5 g/l of zirconium nitrate solution. The mother material was a plate (100 mm long×50 mm wide×1 mm thick) of aluminum (A5052) assigned as the anode (positive electrode) while the cathode (negative electrode) was made of a carbon electrode. The temperature of the electrolyte liquid was set to 5° C. for the electrolytic process. An AC/DC combined current was supplied at a ratio between the alternating current and the direct current being 1:1 and its density was 2 A/dm$^2$. The electrolytic process was continued for 30 minutes and then the anodized layer developed was measured 20 μm in the thickness.

The emission of negative ions (the number of ions per centimeter square) from the anodized layer developed on the mother material by the electrolytic process was measured using a negative ion meter (EB-12A, made by Ecoholistic)

Example 2

Example 2 of the electrolytic process was carried out with the treatment system shown in FIG. 1 using as the electrolyte liquid 100 g/l of sulfuric acid doped with 2 g/l of zirconium acetate in which a plate (100 mm long×50 mm wide×1 mm thick) of aluminum (A1050) as the mother material covered with an anodized layer of 10 μm thick was immersed. An alternating current was supplied between the plate to be treated and a carbon electrode. The current density was 1.0 A/dm$^2$ and the temperature of the electrolyte liquid was 20° C. The electrolytic process was continued for 15 minutes. After the electrolytic process, the emission of negative ions from the anodized layer developed on the mother material was measured using the same negative ion meter as of Example 1.

Example 3

Example 3 of the electrolytic process was carried out with the treatment system shown in FIG. 1 using an electrolyte bath of 50 g/l of phosphoric acid in which the same mother material as of Example 3 covered with an anodized layer of 20 μm thick was immersed as the anode with a carbon electrode as the cathode. While the temperature of the electrolyte bath was 25° C., a direct current was supplied for the electrolytic process at a density of 1.5 A/dm$^2$. The electrolytic process was continued for 10 minutes. Then, the electrolytic process was repeated using 100 g/l of sulfuric acid doped with 10 g/l of zirconiumnitrate solution. After the electrolytic process, the emission of negative ions from the anodized layer developed on the mother material was measured using the same negative ion meter as of Example 1.

Example 4

Example 4 of the electrolytic process was carried out with the treatment system shown in FIG. 1 using as an electrolyte liquid containing 2 g/l of silver sulfate and 10 g/l of zirconium oxychloride. The same mother material was used as of Example 1. After the electrolytic process conducted under the same conditions as of Example 1, the emission of negative ions from the anodized layer developed on the mother material was measured using the same negative ion meter as of Example 1.

Example 5

Example 5 of the electrolytic process was carried out with the treatment system shown in FIG. 1 using an electrolyte bath of 10 g/l of sulfuric acid doped with 5 g/l of silver nitrate and 10 g/l of zirconium oxychloride in which the same mother material as of Example 1 covered with an anodized layer of 10 μm thick was immersed. While the temperature of the electrolyte bath was 25° C., an alternating current was supplied at a density of 1.0 A/dm$^2$ between the plate and the carbon electrode. The electrolytic process was continued for 10 minutes. After the electrolytic process, the emission of negative ions from the anodized layer developed on the mother material was measured using the same negative ion meter as of Example 1.

Example 6

Example 6 of the electrolytic process was carried out with the treatment system shown in FIG. 1 using as the electrolyte liquid 50 g/l of phosphoric acid in which a plate (100 mm long×50 mm wide×1 mm thick) of aluminum (A1050) as the mother material covered with an anodized layer of 20 μm thick was immersed as the anode with a carbon electrode as the cathode. The temperature of the electrolyte liquid was 25° C. A direct current was supplied and its density was 1.5 A/dm$^2$. The electrolytic process was continued for 10 minutes under the described conditions. Then, the electrolytic process was repeated using as the electrolyte liquid 50 g/l of sulfuric acid doped with 5 g/l of silver nitrate and 10 g/l of zirconium nitrate. After the electrolytic process, the emission of negative ions from the anodized layer developed on the mother material was measured using the same negative ion meter as of Example 1.

Example 7

Example 7 of the electrolytic process was carried out with the treatment system shown in FIG. 1 using a plate of aluminum (A5052) covered partially with a fluorine resin coating. The electrolytic process was conducted under the same conditions as of Example 4 for developing an anodized layer of 30 μm thick on the exposed surface of the plate (where the fluorine resin coating was absent). As the result, the exposed aluminum surface of the plate (where the fluorine resin coating was absent) appeared in gold color indicating that silver was deposited on the anodized layer. The fluorine resin coated surface of the plate however remained unchanged in the appearance exhibiting no color. After the electrolytic process, the emission of negative ions from the mother material of Example 7 was measured using the same negative ion meter as of Example 1.

The measurements of the emission in Examples 1 to 7 are shown in Table 1. As apparent from Table 1, each of Examples 1 to 6 produces as a large number of negative ions as 5000 to 6500 ions/cm$^3$. It is also proved that Example 7 produces 3500 ions/cm$^3$.

TABLE 1

| | Thickness of anodized layer | Color | Emission of negative ions |
|---|---|---|---|
| Example 1 | 20 (μm) | Silver | 5000 (ions/cm$^3$) |
| Example 2 | 10 | Silver | 5000 |
| Example 3 | 20 | Silver | 6000 |
| Example 4 | 20 | Gold | 5000 |
| Example 5 | 10 | Gold | 6000 |
| Example 6 | 20 | Silver | 6500 |
| Example 7 | 30 | Gold | 3500 |
| Comparison 1 | 25 | Silver | 0 |
| Comparison 2 | 25 | Silver | 0 |
| Comparison 3 | 25 | Silver | 0 |

Comparison 1

Comparison 1 of the electrolytic process was carried out with the treatment system shown in FIG. 1 using as the electrolyte liquid 150 g/l of sulfuric acid (which contained non of metal nitrate, metal sulfate, and rare metal salt). The mother material was a plate (100 mm long×50 mm wide ×1 mm thick) of aluminum (A5052) assigned as the anode, while the cathode was a carbon electrode. The temperature of the electrolyte liquid was 5° C. An AC/DC combined current was supplied at a ratio of 1:1 between the alternating current and the direct current. Its density was 2.5 A/dm$^2$. The electrolytic process was continued for 30 minutes under the described conditions. After the electrolytic process, the emission of negative ions from the anodized layer developed on the mother material was measured using the same negative ion meter as of Example 1.

Comparison 2

Comparison 2 of the electrolytic process was carried out using the same mother material as of Comparison 1 on which an anodized layer was developed under the same conditions as of Comparison 1. The mother material of a plate and the carbon electrode were energized with an alternating current in the electrolyte bath having 100 g/l of sulfuric acid (which contained non of rare metal salt, metal nitrate, and metal sulfate). The action of the electrolytic process was done under the same conditions as of Example 3. Then, the emission of negative ions from the anodized layer on the mother material was measured using the same negative ion meter as of Example 1.

Comparison 3

Comparison 3 of the electrolytic process was carried out under the same conditions as of Example 4 for developing an anodized layer on the mother material. The mother material was electrolytically processed at a direct current in an electrolyte liquid having 50 g/l of sulfuric acid (which contained non of rare metal salt, metal nitrate, and metal sulfate). The mother material of a plate and the carbon electrode were energized with an alternating current under the same conditions as of Example 3. Then, the emission of negative ions from the anodized layer on the mother material was measured using the same negative ion meter as of Example 1.

The measurements of Comparisons 1 to 3 are shown in Table 1 for comparison with those of Examples 1 to 7. As apparent from Table 1, the emissions of negative ions from the anodized layer on the mother material are zero in Comparisons 1 to 3 as having never been detected.

What is claimed is:

1. A method of manufacturing a negative ion generating medium characterized by electrolytically processing a mother material made of aluminum or aluminum alloy in an electrolyte liquid of sulfuric acid, oxalic acid, phosphoric acid, or their two or three combination doped with a negative ion generating metal salt to develop an anodized layer on the surface of the mother material and to deposit a negative ion generating metal from the negative ion generating metal salt on the anodized layer.

2. A method of manufacturing a negative ion generating medium characterized by electrolytically processing a mother material made of aluminum or aluminum alloy and covered at the surface with an anodized layer in an electrolyte liquid of sulfuric acid, oxalic acid, phosphoric acid, or their two or three combination doped with a negative ion generating metal salt and with either silver nitrate, copper nitrate, or their combination or silver sulfate, copper sulfate, or their combination to deposit a negative ion generating metal from the negative ion generating metal salt and a specific metal from the metal nitrate or metal sulfate on the anodized layer.

3. A method of manufacturing a negative ion generating medium characterized by subjecting a mother material made of aluminum or aluminum alloy and covered at the surface with an anodized layer to an electrolytic process in a phosphoric acid bath to modify the shape of the anodized layer and electrically processing the mother material in an electrolyte liquid of sulfuric acid, oxalic acid, or their combination doped with a negative ion generating metal salt to deposit a negative ion generating metal from the negative ion generating metal salt on the anodized layer which has been modified in the shape.

4. A method of manufacturing a negative ion generating medium characterized by electrolytically processing a mother material made of aluminum or aluminum alloy and covered at least partially at the surface with a granular resin coating in an electrolyte liquid of sulfuric acid, oxalic acid, phosphoric acid, or their two or three combination doped with a negative ion generating metal salt to develop an anodized layer on the surface of the mother material and to deposit a negative ion generating metal from the negative ion generating metal salt on both the anodized layer and the granular resin coating.

5. A method of manufacturing a negative ion generating medium according to claim 4, wherein the granular resin coating is made of fluorine resin, phenol resin, or acrylic resin.

6. A method of manufacturing a negative ion generating medium characterized by electrolytically processing a mother material made of aluminum or aluminum alloy and covered at least partially at the surface with a granular resin coating and with an anodized layer in an electrolyte liquid of sulfuric acid, oxalic acid, phosphoric acid, or their two or three combination doped with a negative ion generating metal salt to deposit a negative ion generating metal from the negative ion generating metal salt on both the anodized layer and the granular resin coating.

7. A method of manufacturing a negative ion-generating medium according to any of claims 1 to 4 or 6, wherein the negative ion generating metal is composed of one or more metals selected from the group consisting of zirconium, vanadium, lithium, yttrium, thorium, uranium, radium, and radon.

8. A method of manufacturing a negative ion generating medium according to claim 7, wherein the electrolytic process is carried out using a commercial alternating current, an AC/DC combined current, a PR current at the negative mode, a pulse waveform current at the negative mode, or their combination.

* * * * *